US008550282B1

(12) United States Patent
Libhart et al.

(10) Patent No.: US 8,550,282 B1
(45) Date of Patent: Oct. 8, 2013

(54) SECURITY LATCH DEVICE FOR DUMPING TRASH CONTAINERS AND COMBINATION THEREOF

(76) Inventors: Anthony Canova Libhart, Huntsville, AL (US); Charles Carter Patterson, Madison, AL (US)

( * ) Notice: Subject to any disclaimer, the term of this patent is extended or adjusted under 35 U.S.C. 154(b) by 617 days.

(21) Appl. No.: 12/662,071

(22) Filed: Mar. 30, 2010

Related U.S. Application Data

(60) Provisional application No. 61/202,783, filed on Apr. 3, 2009.

(51) Int. Cl.
*B65D 45/16* (2006.01)

(52) U.S. Cl.
USPC ..... 220/234; 220/264; 220/315; 220/908; 292/230; 292/DIG. 4; 292/DIG. 22; 414/407

(58) Field of Classification Search
USPC ..... 220/264, 315, 324, 908; 292/230, 292/DIG. 4, DIG. 22; 414/407
See application file for complete search history.

(56) References Cited

U.S. PATENT DOCUMENTS

| | | | | |
|---|---|---|---|---|
| 5,201,434 | A * | 4/1993 | DeVivo et al. | 220/315 |
| 5,474,341 | A | 12/1995 | Putman | |
| 5,662,364 | A | 9/1997 | Reeb | |
| 5,738,395 | A | 4/1998 | Probst | |
| 5,997,052 | A | 12/1999 | Reeb | |
| 6,578,762 | B1 | 6/2003 | Knappmiller | |
| 6,644,907 | B1 | 11/2003 | Pinder | |

* cited by examiner

*Primary Examiner* — Anthony Stashick
*Assistant Examiner* — Elizabeth Volz

(57) ABSTRACT

A gravity-responsive system for securing or restraining the lid or lids of dumping containers in their on-the-ground position and releasing the lid or lids when the container is lifted to its overhead dump position includes a pivotally mounted over-center swingarm that is connected via a connecting link to a lid-restraining bail. When the dumping container is substantially in its on-the-ground position, the bail is rotated to a lid-securing or restraining position in which the lid or lids cannot be opened fully. As the dumping container is lifted toward and to is overhead dump position, the swing-arm rotates in response to gravity to move the bail toward and to a lid-release position to allow the lid or lids to swing away from their closed position to allow the dumping of the contents into the trash truck.

14 Claims, 7 Drawing Sheets

SECURITY LATCH DEVICE FOR DUMPING TRASH CONTAINERS AND COMBINATION THEREOF

CROSS-REFERENCE TO RELATED APPLICATION

This application claims the benefit of U.S. provisional patent application No. 61/202,783 filed Apr. 3, 2009 by the applicants herein, the disclosure of which is incorporated herein by reference.

BACKGROUND

The present invention relates generally to latching systems utilizing gravity-control for the securing and the releasing of a lid or lids on dumping containers and the combination of such security devices and their associated dumping containers as well as kits intended to be retrofitted to existing dumping containers.

The unauthorized deposit of trash into common dumpable trash containers is a problem for unsecured containers. An unlocked container is an open temptation for the deposit of discarded food products, potentially hazardous waste materials, electronic components, and potentially dangerous chemical products, etc. Additionally, an unsecured dumping container is a convenient place to discard human and animal remains and other biologic material. One common solution is to lock the container using a key-operated padlock; however, this solution is dependent upon the consistent use thereof by a human operator or custodian.

Further, homeless individuals will often pilfer dumping containers for food or other edible materials with the potential for food poisoning and the like; dumping containers have also been utilized as temporary living quarters for destitute persons with the risk that a person in the container will be lifted into the trash compartment of a trash collection truck with the further risk of being crushed by the compacting equipment found in most trash collection trucks.

The existing method for securing dumping containers can be unreliable since human error is a factor in the failure to consistently secure dumpable trash containers.

A reliable method is needed to insure reliable unlatching or unlocking, emptying, closure, and re-latching or re-locking of lids without the driver of the trash collection vehicle having to exit and then re-enter the vehicle.

SUMMARY

A gravity-responsive system for securing or restraining the lid or lids of dumping containers in their on-the-ground position and releasing the lid or lids when the container is lifted to its overhead dump position includes a pivotally mounted over-center swing-arm that is connected via a connecting link to a lid-restraining bail. When the dumping container is substantially in its on-the-ground position, the bail is rotated to a lid-securing or restraining position in which the lid or lids cannot be opened fully. As the dumping container is lifted toward and to is overhead dump position, the swing-arm rotates in response to gravity to move the bail toward and to a lid-release position to allow the lid or lids to swing away from their closed position to allow the dumping of the contents into the trash truck. As the now-empty dumping container is moved toward and to its former on-the-ground location, the bail is then moved under the influence of the swing-arm toward and to the lid-restraining position; in this on-the-ground and lid-restraining state, the bail cannot be manually moved by an unauthorized person to a lid-releasing position to prevent opening of the lids.

The gravity responsive system is provided with a locking tab/notch arrangement by which the bail can be key-locked by an authorized user into either its lid-restraining or lid-release positions.

The system eliminates the problem of the truck driver/operator failing to re-lock the container using the prior padlock arrangement to thereby minimize problems associated with lost keys and/or locks and the unauthorized deposit of trash to thus increase manpower and fuel efficiency and provide a greater degree of safety and privacy by minimizing unauthorized access to the container.

DESCRIPTION OF THE PREFERRED EMBODIMENTS

Figure 1:
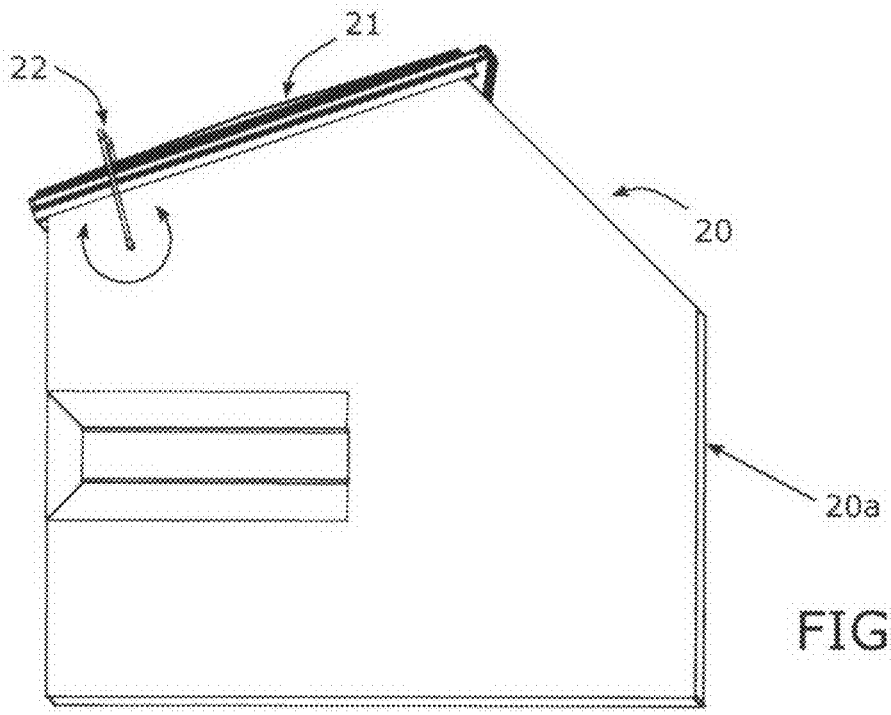
FIG. 1 is a side view of an exemplary dumpable trash container in its normal on-the-ground position with a bail shown in a lid-securing or lid-restraining position.
Figure 2:
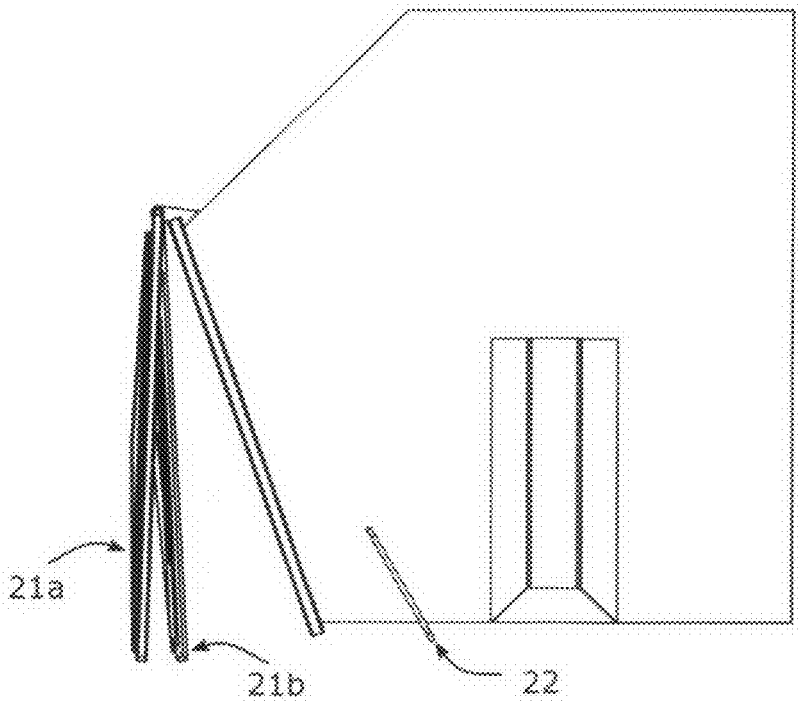
FIG. 2 is a side view of the dumpable trash container of FIG. 1 showing the container in 90° counterclockwise position (relative to the position shown in FIG. 1) showing the bail in a lid-release position with the lids having swung away from the top opening of the trash container.

FIG. 1 is a side view of a conventional dump-type trash or refuse container 20 that, as is typical, includes a lower body 20*a* fabricated as a steel weldment and a container lid 2. The container lid 21 can be a single lid molded from a high-strength plastic or, as is also common, a set to two adjacent lids 21*a*-21*b* (FIG. 2). Additionally, welded lift-sleeve formations (unnumbered) are provided on each side of the container 20 to accept the tines or forks commonly used on dumpster-type trash trucks to lift the container 20 from its on-the-ground position and over a part of the trash truck (such as the truck cab) to dump the contents.

In FIG. 1, a bail 22 is positioned in its lid-securing or lid-restraining position so that the lid 21 or lids 21*a*-21*b* cannot be fully opened or opened enough to gain meaningful access to the interior of the container 20. In general, the bail 22 extends from one side of the container 20 to the other and can be fabricated from a steel bar stock. As shown in FIG. 2, which corresponds to the container 20 in its "lifted" or "dump" position, the bail 22 has been moved to a lid-release position in which the lid 21 or lids 21*a*-21*b* are moved or swung to an open position by gravity. The bail 22 extends from one side of the container 20 to the other and is pivotally mounted to the container 20 as shown. As explained below, the mechanism that connects to the bail 22 is designed to self- or auto-latch the bail 22 to its lid-restraining position when the container 20 is in its on-the-ground position and auto-unlatch when the container 20 is lifted or raised to its dump position. As explained below, the bail 22 can also be key-locked or unlocked by an authorized user in either its lid-securing position (FIG. 1) or its lid-release position (FIG. 2). In general, the bail 22 in its lid-restraining position prevents the lid 21 or lids 21*a*-21*b* from being opened enough so that unauthorized materials can be easily placed in container 20 or removed therefrom; as can be appreciated, it is expected that some dimensional clearances in some applications may allow for some opening of the lid 21 or lids 21*a*-21*b* before contacting the bail 22.

Figure 3:
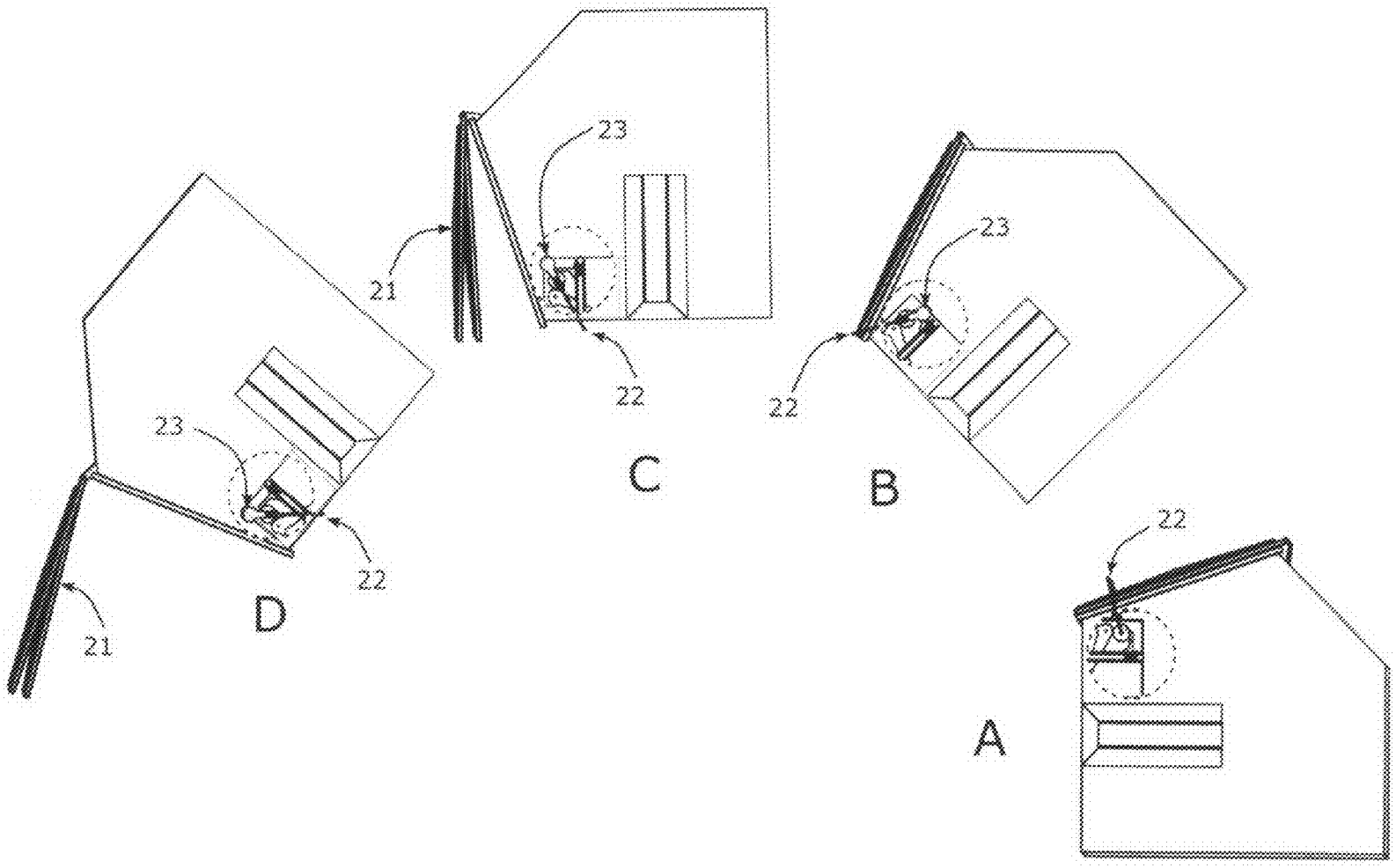
FIG. 3 is a side view of the dumpable trash container of FIGS. 1-2 shown being lifted from its on-the-ground position through a curved or arc-like pathway or trajectory to its elevated dump position with a selected portion of the sidewall broken away to show an interior mechanism for controlling the bail.

FIG. 3 illustrates the container 20 as it is lifted by a trash truck (not shown) from its normal on-the-ground position (i.e., approximately or about 0°), position A, through an arc-shaped path that includes position B (about 45°), a position C (about 90°), and a "full dump" position, position D, (about 135°); as the container 20 is lifted from its 0° starting or initial position at position A, the container 20 is also effectively "tilted" relative to its starting or initial position. In general, the on-the-ground description refers to containers 20 that are positioned on paved or unpaved surfaces, which surfaces can be substantially flat and "level" or, in some cases, uneven and/or somewhat non-level. In FIG. 3, a circular portion of the sidewall of the container 20 has been "cut-away" to reveal interior components (discussed in more detail below), including a counterweight or counterbalance 23 that is attached to the bail 22.

In position A, the bail 22 is in its lid-restraining position and is normally self- or auto-latched in that position to prevent unauthorized access to the interior of the trash container 20, as explained below. As the container 20 is lifted and tilted at some angle relative to the ground surface, the bail 22 is unlatched from its latched position and rotates counterclockwise from its lid-securing or lid-restraining position (position A) toward the position shown position B. At some point between position B and position C, the bail 22 "clears" the remote ends of the lid 21 or lids 21*a*-21*b* so that the lid(s) are free to open or swing away from their closed position under the influence of gravity. With continued movement of the container 20 to and toward the "full-open dump" position shown at position D, the contents of the container 20 are dumped into the trash compartment of the trash truck or vehicle. After the dumping operation is completed, the container 20 is brought back to its on-the-ground position, position A, with the lid 21 or lids 21*a*-21*b* moving to the closed position as the bail 22 also rotates clockwise toward and to its lid-restraining or lid-securing position and self- or auto-latchs at that position. As can be appreciated, the latching and unlatching features assures that the bail 22 is in its lid-restraining or lid-securing position while the container 20 is on the ground and moving toward and to its lid-releasing position when the container 20 is being lifted or raised to its dump position.

Figure 4C:
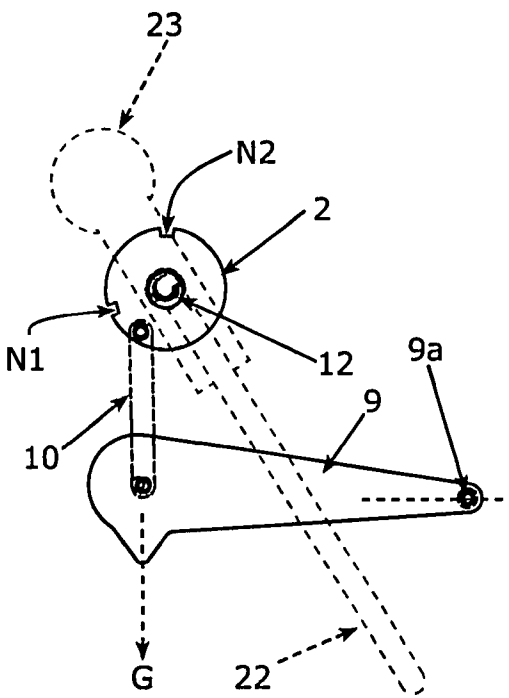
FIGS. 4A, 4B, and 4C show basic mechanical components that control the movement of a bail.
Figure 4B:
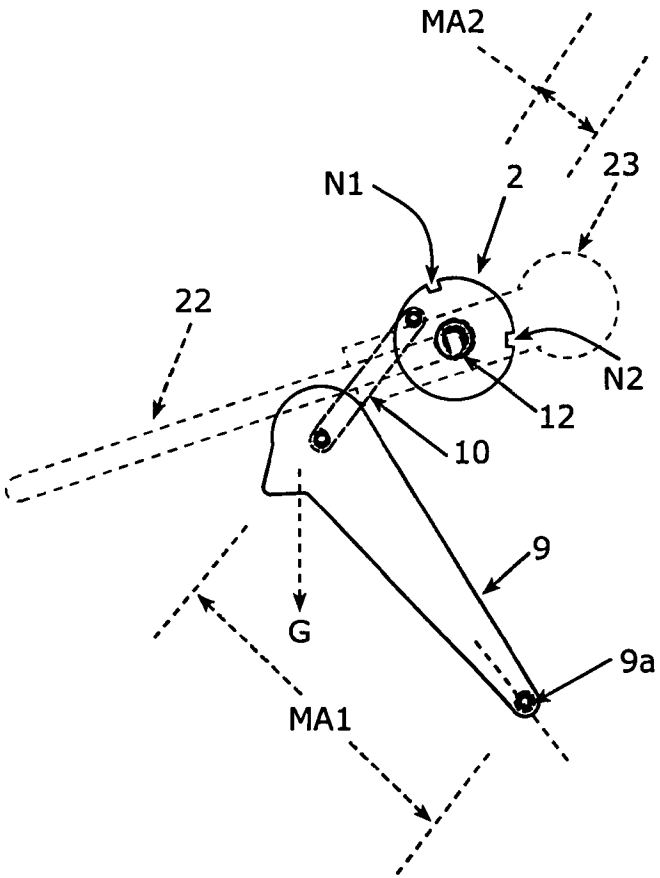
Figure 4A:
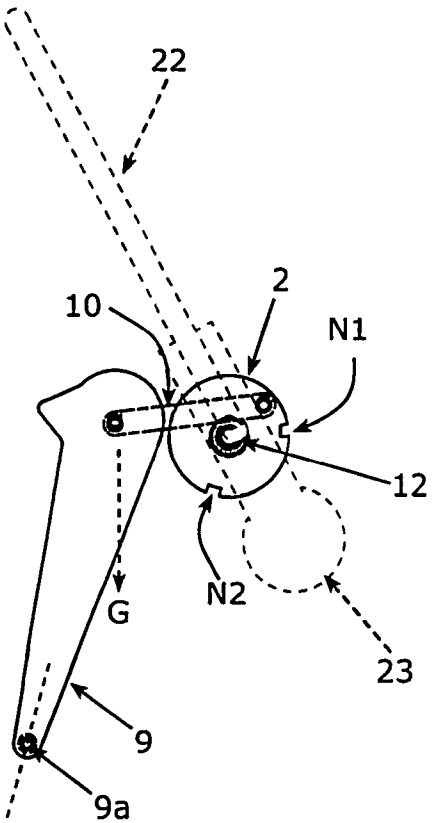

FIGS. 4A, 4B and 4C shown the basic components that control movement of the bail 22 and a counterweight 23 (both in dotted-line illustration) throughout its range of motion. As shown in FIGS. 4A, 4B and 4C, the rotational movement of the bail 22 and its counterbalance 23 is controlled in response to the mechanical relationship between an end-weighted over-center swing-arm 9 (i.e., an inverted pendulum) and a disc or wheel 2 interconnected by a link-connector 10. The link-connector 10 is pivotally connected at its opposite ends, respectively, to the swing-arm 9 and the wheel 2, as described more fully below in relationship to FIGS. 5A-5C and 6. The bail/counterweight 22/23 is connected to the wheel 2 for rotation therewith by slotted rotator shaft 12 (shown in more detail in FIG. 8). Basically, rotation of the swing-arm 9 about its pivot axis 9*a* causes a corresponding rotation of the wheel 2 via the link-connector 10 and movement of the connected bail 22 and its connected counterbalance 23. The wheel 2 includes first and second notches N1 and N2 that cooperate with a pawl or tab, as described below, to latch the bail 22 in either its lid-restraining or lid-releasing positions.

The swing-arm 9 is mounted for bi-directional rotation about a pivot or journal 9*a* and extends upwardly therefrom with the swing-arm 9 shaped to increase the weight or mass toward the remote or distal end. The swing-arm 9 thus can "fall" clockwise or counterclockwise under the influence of gravity. Since the swing-arm 9 is connected via the link-connector 10 to the wheel 2, the wheel 2 (and the connected bail/counterweight 22/23) can be rotated clockwise or counterclockwise in response to movement of the swing-arm 9 about its pivot 9*a*.

In the configuration shown in FIG. 4A (which corresponds to the on-the-ground position A of FIG. 3), and when the swing-arm 9 is rotated clockwise under the influence of gravity G and the wheel 2 is similarly rotated clockwise, as shown in FIG. 4A, the bail 22 is positioned in its lid-securing or lid-constraining position by which the lid 21 or lids 21*a*-21*b* cannot be fully opened. The counterweight 23 is sized and positioned to reduce or minimize those torque forces necessary to move the bail 22 between is end positions. In some applications, the use of a counterweight may be optional.

As shown in FIG. 4B (which substantially corresponds to position B in FIG. 3) and as the swing-arm 9 pivots counterclockwise in response to the container 20 being lifted and tilted counterclockwise, the counterclockwise pivoting swing-arm 9 pulls the link-connector 10 causing the wheel 2 to rotate in the counterclockwise direction to cause the connected bail/counterweight 22/23 to rotate toward the lid-release or lid-clearance position.

As shown in FIG. 4C (which corresponds to a position intermediate positions C and D in FIG. 3) and with continued pivoting of the swing-arm 9 as the container 20 is further lifted and tilted, the bail/counterweight 22/23 is rotated counterclockwise to the position shown with the bail 22 in its lid-release position. The movement of the parts is bi-directional; as the container 20 is lowered and counter-tilted toward its on-the-ground position, the bail 22 will return to its lid-restraining or lid-securing position.

Thus, the mechanical components of FIGS. 4A-4C provide for the bi-directional movement of the bail 22 between its lid-securing position and its lid-release position as the container 20 is lifted from its on-the-ground position through to its "dump" position and back to its on-the-ground position. The distance between the pivot 9A and the pivot connection for the link-connector 10 on the swing-arm 9 constitutes a first moment arm MA1 (see FIG. 4B) and the distance between the pivot 12 of the wheel 2 and the pivot connection for the link-connector 10 on the wheel constitutes a second moment arm MA2, the respective dimensions of which can be varied to control the torque applied to the bail 22. As explained below, the notches N1 and N2 in the wheel 2, cooperating with a below-described trigger allow the bail 22 to self- or autolatch in its lid-restraining position when the container 20 is in its on-the-ground position and, additionally, allow for bail 22 to unlatch as it is moved to and toward its dump position.

FIGS. 5A-5C and FIG. 6 are more detailed views of the components of FIGS. 4A, 4B, and 4C contained within a box-lock assembly 1 and further showing a trigger 6 and a lock assembly 16. The configuration of the swing-arm 9, link connector 10, and wheel 2 in FIG. 5A corresponds to the configuration shown in FIG. 4A when the container 20 is in its on-the-ground position (i.e., position A in FIG. 3) with the bail 22 in its lid-restraining or lid-locking position.

As mentioned above, the wheel 2 includes the two notches N1 and N2 that assist in retaining the components in one of two configurations corresponding to the bail 22 in its lid-restraining position and its lid-release position.

Figure 11:
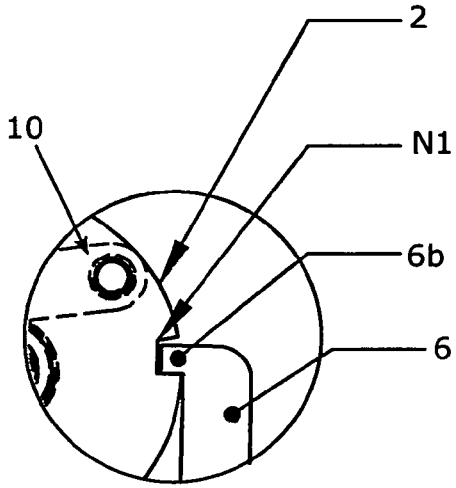
FIG. 11 is a detail view of a portion of the wheel/lock tab organization of FIG. 7.

The trigger 6 is mounted for bi-directional rotation about a journal or pivot 6*a* and includes a pawl or tab 6*b* at its upper or remote end that is designed to interengage with either the notch N1 or the notch N2; FIG. 11 is enlarged detail showing the interengagement of the tab 6*b* and one of the notches. The lower end of the trigger 6 is shaped to include more mass or weight on the left side of the trigger 6 (i.e., to the left from the viewpoint of FIG. 5A and to the left of a vertical axis passing through the axis of pivot 6*a*). When the container 20 is in its on-the-ground position (position A in FIG. 3), the influence of gravity G on the mass or weight distribution at the lower end of the trigger 5 tends to bias the trigger 6 for rotation in the counterclockwise direction (from the perspective of FIG. 5A) and tends to bias the tab 6*b* toward the periphery of the wheel 2. Thus, during those times when the trigger 6 is so biased, the tab 6*b* will enter the notch N1 or N2 and lock or arrest rotation of the wheel 2.

Figure 5B:
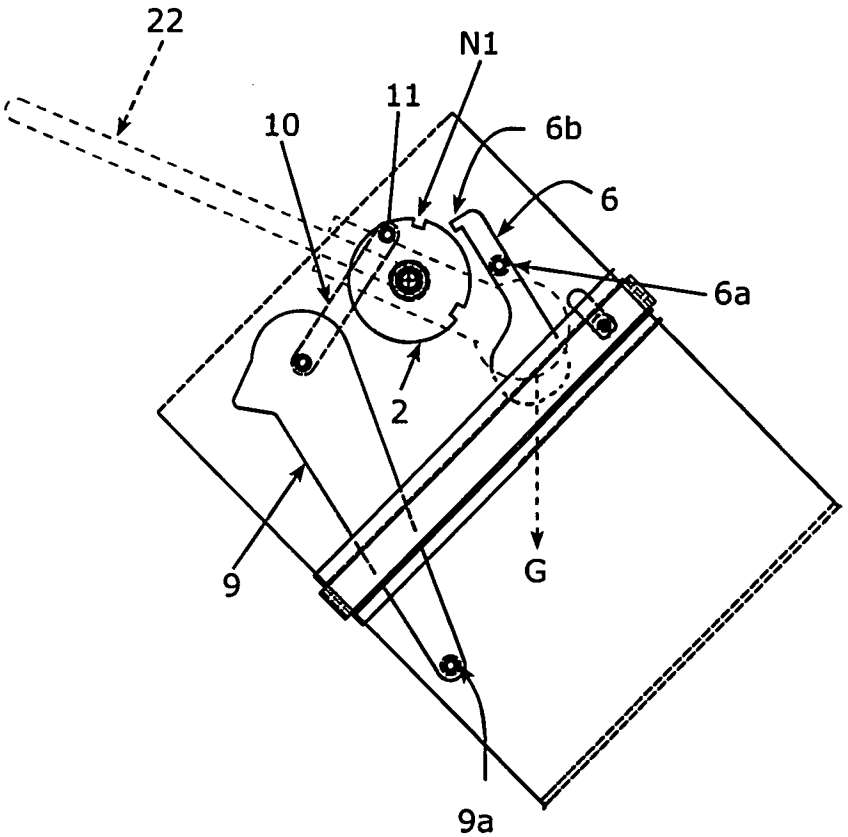
FIGS. 5A-5C show the components of FIGS. 4A, 4B, and 4C cooperating with a pivotable trigger for latching and unlatching the bail.
Figure 5A:
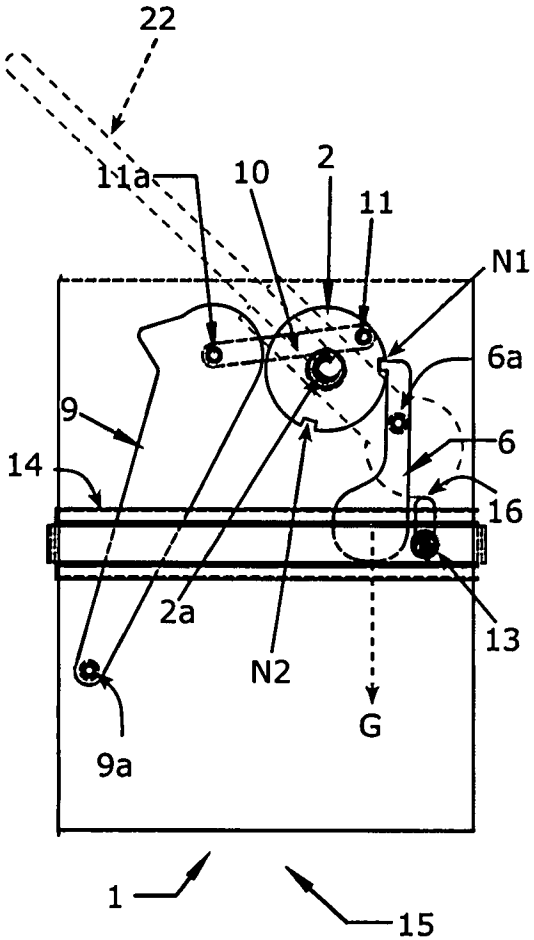
Figure 5C:
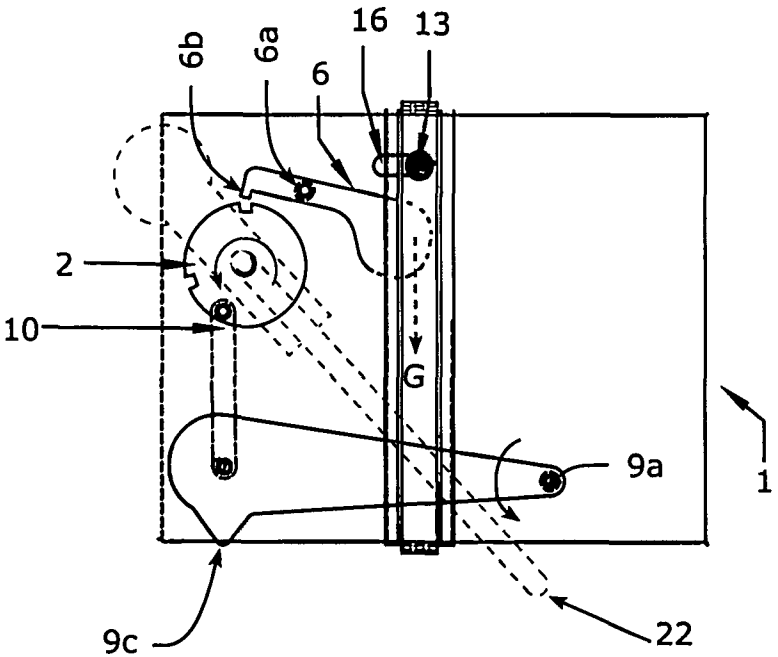

In the container 20 is in its on-the ground configuration with the various parts positioned as shown in FIG. 5A, the tab 6*b* will engage the notch N1 to arrest motion of the wheel 2 and the interconnected bail 22 will be locked or arrested in its lid-restraining or lid-securing position thereby preventing unauthorized access into the container 20. When the container is lifted from its on-the-ground position (i.e., position A in FIG. 3) toward position B in FIG. 3 (as shown in FIG. 5B), the force of gravity G acting on the mass or weight distribution the lower end of the trigger 6 will cause the trigger 6 to rotate clockwise about its pivot 6*a* to withdraw the tab 6*b* from the notch N1 to allow the wheel 2 (and the connected bail/counterweight 22/23) to rotate counterclockwise under influence of the swing-arm 9 to its full lid-release position, as shown in FIG. 5C. As shown in FIG. 5C, the "beak" like formation 9*c* functions as a mechanical stop to limit motion of the parts.

The movement of the parts shown in FIGS. 51-5C is reversible; thus, as the container 20 is moved from its dump position to and toward its on-the-ground position, the swing-arm 9 will rotate clockwise about the pivot 9*a* to rotate the wheel 2 clockwise moving the bail/counterweight 22/23 to and toward its lid-restraining or lid-securing position with the influence of gravity on the trigger 6 causing the trigger 6 to rotate counterclockwise to bias the tab 6*b* on the periphery of the wheel 6 and eventually into the notch N1 to latch the bail/counterweight 22/23 in its lid-restraining or lid-securing position as the container 20 is returned to its on-the-ground position.

Figure 10:
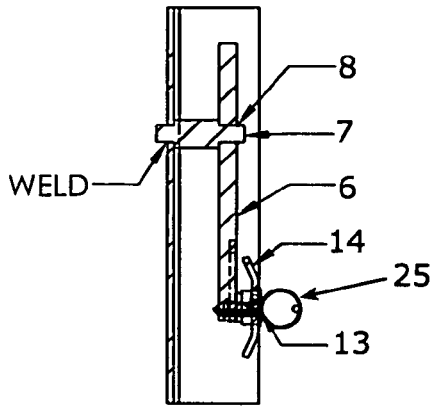
FIG. 10 is a view taken along line 10-10 of FIG. 7.

The self- or auto-latch and auto-unlatch functionality can be disabled by a user by operation a key-operated lock. As shown in FIGS. 5A-5C and FIG. 6, a key-operated cam-lock assembly 13 is mounted in a bar-lock seat 14 and includes a lock-member 16 that is moveable between two positions as seen by comparison of FIG. 5A and FIG. 6. As shown in the detail of FIG. 10, a key 25 is used to operate the cam-lock assembly 13; as is also shown in FIG. 10, the trigger 6 is pivotally mounted on a reduced-diameter portion of a stand-off pivot 7 and held in place by a snap ring 8.

The lock-member 16 can be rotated to the position shown in FIGS. 5A-5C so that the lock 16 member does not interfere with the motion of the trigger 6. In the event the tab 6*b* not in engagement with either notch N1 or N2 and when the container 20 is in its on-the-ground position, the tab 6*b* in biased toward and into contact the periphery of the wheel 2 by virtue of the mass distribution at the lower end of the trigger 6 as discussed above. In the event the user grasps the bail 22 and pulls the bail 22 down to the lid-release position, the tab 6*b* will enter the notch N2 and lock the bail 22 in its lid-release position or, alternatively, if the bail 22 is pushed to its lid-securing position, the tab 6*b* will enter notch N1 and lock the bail 22 in its lid-restraining position.

Figure 6:
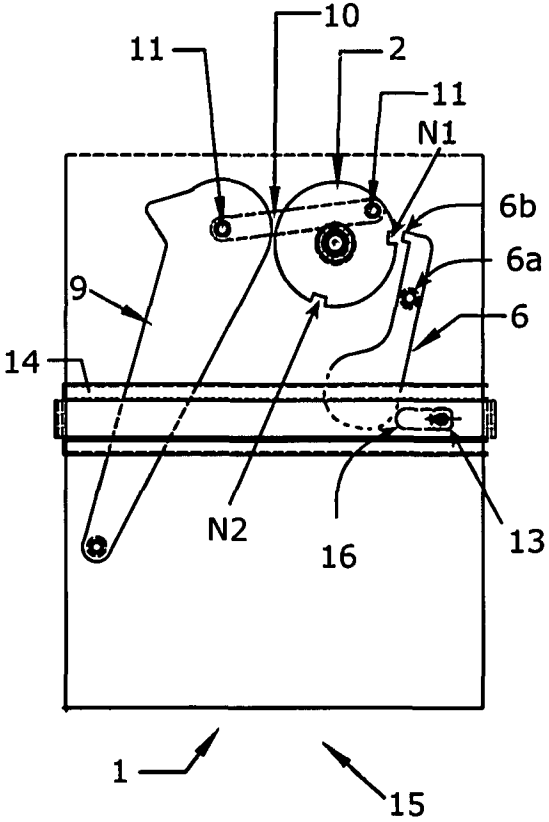
FIG. 6 is more detailed view of the components of FIGS. 5A-5C showing a trigger in a retracted position.

As shown in FIG. 6, when the lock-member 16 is rotated to the position shown, the end of the lock-member 16 engages the lower end of the trigger 6 and functions as a camming surface to force the trigger 6 to rotate clockwise to a trigger-retracted position to move the tab 6*b* away from the periphery of the wheel 2 and prevent any engagement with either notch N1 or N2 and to allow the wheel 2 and the swing-arm 9 (and the connected bail 22/counterbalance 23) to move about their respective pivots. In the configuration of FIG. 6, a user can grasp the bail 22 and manually move it freely between the lid-securing or lid-restraining position and the lid-release position with the various components operating as described above in relationship to FIGS. 3 and 4A, 4B, and 4C. Additionally, the container 20 can be lifted from its on-the-ground position to its dump position and returned to its on-the-ground position without interference from the trigger 6.

It is contemplated that when the components are in the configuration in which the bail 22 is in a position intermediate the lid-restraining position and its lid-release position and the container 20 is in its on-the-ground position, a user can insert the key 25 into the cam-lock assembly 13 and rotate the lock-member 16 to the position shown in FIG. 5A and remove the key 25. Thereafter, the user can push the bail 22 to the lid-restraining position with the tab 6*b* entering notch N1 to lock the bail 22 in its lid restraining position. Alternatively, the user can pull the bail 22 to the lid-release position with the tab 6*b* entering notch N2 to lock the bail 22 in its lid-release position. In either case, lifting the container 20 toward position C in FIG. 3 will cause the trigger 6 to rotate in such a way to unlock the bail 22 and allow movement of the bail 22 to its lid-release position as the container 20 is moved toward its dump position.

Figure 7:
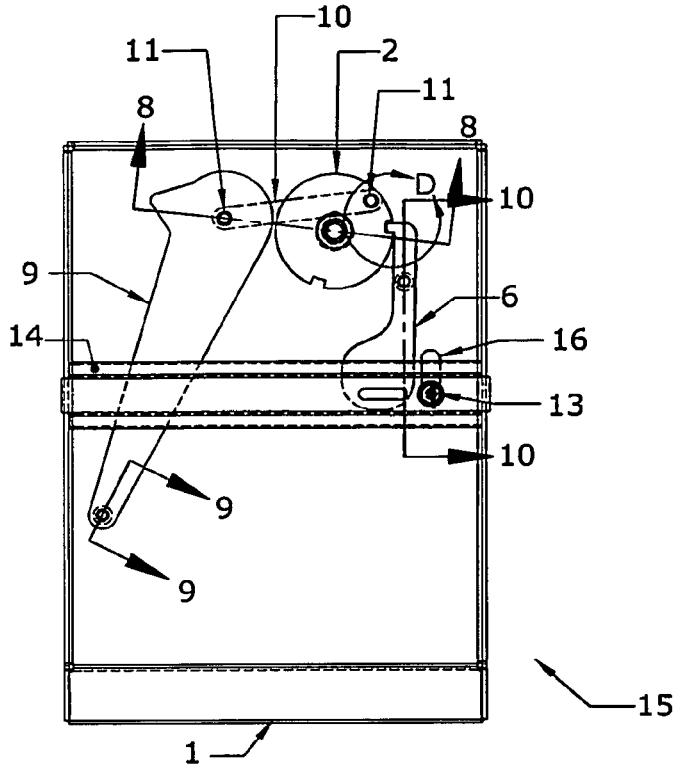
FIG. 7 is a machine drawing of the components shown in FIGS. 1-6C.
Figure 8:
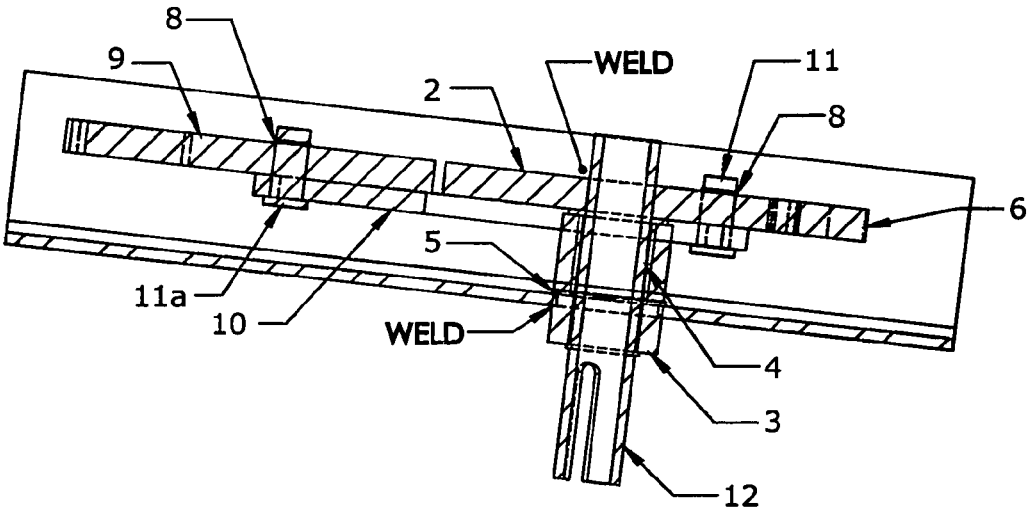
FIG. 8 is a view taken along line 8-8 of FIG. 7.
Figure 9:
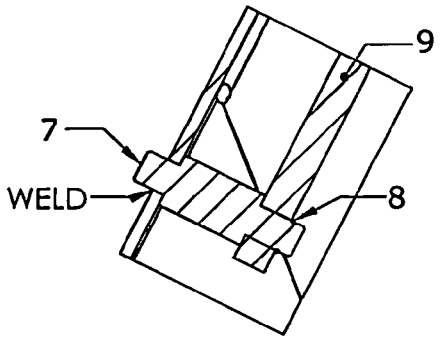
FIG. 9 is a view taken along line 9-9 of FIG. 7.

FIG. 7 is a machine drawing of the components shown in FIGS. 1-6C and FIG. 8 is a view taken along line 8-8 of FIG. 7. FIG. 8 shows the swing-arm 9 pivotally mounted and the wheel 2 mounted on a shaft 12 with the connector link 10 connected at both ends by respective link-pins 11 and held in place by respective snap rings 8. The rotator shaft 12 is shown mounted in a support sleeve 3 and a bearing 4.

In the embodiment described above, the wheel 2 is shown having a full circumference; as can be appreciated, other configurations are possible, including a semicircular disc or a sector disc that subtends less than 360°. Additionally and if desired, springs optionally can be applied to various of the components to effect a desired biasing of the parts toward a preferred or starting position or end position. While the tab 6*b* is shown on the trigger 6 and the notches N1 and N2 are shown on the wheel 2, as can be appreciated the position of these latching features can be reversed.

In the embodiment described above, the components that control the bail 22 are integrated with the structure that defines the trash receiving receptical. It is also contemplated that the invention encompases a kit for retrofitting to prior art dumping containers or dumpsters. The components shown in FIGS. 5A, 5B, and 5C are mounted in a self-contained enclosure that is secured to the side of an existing dumping container by welding or by threaded fasteners with the bail extending therefrom to the opposite wide of the container for connection to an appropriate pivot, journal, or bearing.

As will be apparent to those skilled in the art, various changes and modifications may be made to the illustrated embodiment of the present invention without departing from the spirit and scope of the invention as determined in the appended claims and their legal equivalent.

What is claimed:

1. A dumping container moveable by a dumping vehicle between an on-the-ground position and a tilted position sufficient to enable at least some of the contents of the dumping container to be dumped therefrom and having at least one lid thereon moveably mounted for movement between a closed or substantially closed position when said dumping container is in its on-the-ground position and a non-closed position when said dumping container is in a tilted position sufficient to enable at least some of the contents of the dumping container to be dumped therefrom and a system having a lid-restraining mode and a lid-release mode, the lid-restraining mode for restraining the lid in a closed or substantially closed position when the dumping container is in its on-the-ground position and the lid-release mode for releasing the lid from its lid-restrained mode when the container is tilted toward a position sufficient to enable at least some of the contents of the dumping container to be dumped therefrom, comprising:

a bail moveable between a lid-restraining position and a lid-release position in which the lid is not restrained from moving toward an open position, the bail connected to the container at a pivot connection for rotatable movement thereabout between said lid-restraining position and a position in which the lid is not restrained from moving toward an open position;

a member connected to the bail at the pivot connection for rotation therewith;

a swing-arm pivotally connected at a proximate end thereof, directly or indirectly, to the container and having a remote end thereof moveable through a range of motion as the container is tilted from an on-the-ground position to a tilted position sufficient to enable contents of the dumping container to be dumped therefrom;

a link having one end thereof pivotally connected to the swing-arm at a position spaced from said pivotal connection at the proximate end of said swing-arm and having the opposite end thereof pivotally connected to said member at a position spaced from said pivot connection of said member;

a trigger pivotally mounted at a position intermediate its ends thereof, directly or indirectly, to the container and having a latching element at one end thereof for selective engagement with said member to arrest the movement thereof and having a weight distribution thereof at or adjacent the other end thereof whereby, when the container is in its on-the-ground position, the force of gravity acting on said trigger biases said trigger to enable said latching element to engage said member to arrest movement of said member with said bail in said lid-restraining position and, when said container is tilted toward its tilted position sufficient to enable at least some of the contents of the dumping container to be dumped therefrom, to bias said trigger to disengage said trigger from said member to allow said bail to move to a position in which said lid is not restrained from moving toward an open position sufficient to enable dumping of at least some of the contents of said container.

2. The apparatus of claim 1, further comprising a counterbalance member connected to said bail.

3. The apparatus of claim 1, wherein said trigger is provided with a tab and said member is provided with a notch for selective interengagement therebetween to arrest the movement of said member.

4. The apparatus of claim 1, further comprising a user-operable device for biasing said trigger to a position in which said trigger is disabled from engagement with said member.

5. The apparatus of claim 1, further comprising a key-operated device for biasing said trigger to a position in which said trigger is disabled from engagement with said member.

6. A dumping container moveable by a dumping vehicle between an on-the-ground position and a tilted position sufficient to enable at least some of the contents of the dumping container to be dumped therefrom and having at least one lid thereon moveably mounted for movement between a closed or substantially closed position when said dumping container is in its on-the-ground position and a non-closed position when said dumping container is in a tilted position sufficient to enable at least some of the contents of the dumping container to be dumped therefrom and a system having a lid-restraining mode and a lid-release mode, the lid-restraining mode for restraining the lid in a closed or substantially closed position when the dumping container is in its on-the-ground position and the lid-release mode for releasing the lid from its lid-restrained mode when the container is tilted toward a position sufficient to enable at least some of the contents of the dumping container to be dumped therefrom, comprising:

a bail moveable between a lid-restraining position and a lid-release position in which the lid is not restrained from moving toward an open position, the bail connected to the container at a journaled connection for rotatable movement thereabout between said lid-restraining position and a position in which the lid is not restrained from moving toward an open position;

means connected to said bail and responsive to gravity for moving the bail to a lid-restraining position when the container is in its on-the-ground position and for moving the bail toward and to the position in which the lid is not restrained from moving toward an open position when the container is moved to a tilted position; and a gravity-actuated trigger for latching said means in its lid-restraining position when the container is in its on-the-ground position and for un-latching said means when the container is moved to a tilted position, a wheel member connected to said bail for rotation therewith, wherein said trigger is proved with a tab and said wheel member is provided with a notch for selective interengagement therebetween to arrest the movement of said wheel member.

7. The apparatus of claim 6, further comprising a counterbalance member connected to said bail.

8. The apparatus of claim 6, further comprising a user-operable device for biasing said trigger to a position in which said trigger is disabled from engagement with said means to arrest the movement thereof.

9. The apparatus of claim 6, further comprising a key-operated device for biasing said trigger to a position in which said trigger is disabled from engagement with said means to arrest the movement thereof.

10. A mechanism for controlling the bail of a dumping container moveable by a dumping vehicle between an on-the-ground position and a tilted position sufficient to enable contents of the dumping container to be dumped therefrom and having at least one lid thereon moveably mounted for movement between a closed or substantially closed position when said dumping container is in its on-the-ground position and a non-closed position when said dumping container is in a tilted position sufficient to enable contents of the dumping container to be dumped therefrom, the mechanism having a lid-restraining mode and a lid-release mode, the lid-restraining mode for restraining the lid in a closed or substantially closed position when the dumping container is in its on-the-ground position and the lid-release mode for releasing the lid from its lid-restrained mode when the container is tilted toward a position sufficient to enable contents of the dumping container to be dumped therefrom, said mechanism comprising:

a bail moveable between a lid-restraining position and a lid-release position in which the lid is not restrained from moving toward an open position, the bail connected to the container at a pivot connection for rotatable movement thereabout between said lid-restraining position and a lid-release position in which the lid is not restrained from moving toward an open position;

a member connected to the bail at the pivot connection for rotation therewith;

a swing-arm pivotally connected at a proximate end thereof, directly or indirectly, to the container and having a remote end thereof moveable through a range of motion as the container is tilted from an on-the-ground position to a tilted position sufficient to enable at least some contents of the dumping container to be dumped therefrom;

a link having one end thereof pivotally connected to the swing-arm at a position spaced from said pivotal connection at the proximate end of said swing-arm and having the opposite end thereof pivotally connected to said member at a position spaced from said pivotal connection;

a trigger pivotally mounted at a position intermediate its ends thereof, directly or indirectly, to the container and having a latching element at one end thereof for selective engagement with the member to arrest the movement thereof and having a weight distribution thereof at or adjacent the other end thereof whereby, when the container is in its on-the-ground position, the force of gravity acting on said trigger biases said trigger to enable said latching element to engage said member to arrest movement of said member with said bail in said lid-restraining position and, when said container is tilted toward its tilted position sufficient to enable contents of the dumping container to be dumped therefrom, to bias said trigger to disengage said trigger from said member to allow said bail to move to a position in which said lid is not restrained from moving toward an open position sufficient to enable dumping of contents of said container.

11. The mechanism of claim 10, further comprising a counterbalance member connected to said bail.

12. The mechanism of claim 10, further comprising a latchable member connected to said bail for rotation therewith, wherein said trigger is provided with a tab and said latchable member is provided with a notch for selective interengagement therebetween to arrest the movement of said latchable member.

13. The mechanism of claim 10, further comprising a user-operable device for biasing said trigger to a position in which said trigger is disabled from engagement with said latchable member.

14. The mechanism of claim 10, further comprising a key-operated device for biasing said trigger to a position in which said trigger is disabled from engagement with said latchable member.

* * * * *